US006779569B1

(12) United States Patent
Teer, Jr. et al.

(10) Patent No.: US 6,779,569 B1
(45) Date of Patent: Aug. 24, 2004

(54) LIQUID FILLING CONTROL METHOD FOR MULTIPLE TANKS

(75) Inventors: Robert J. Teer, Jr., Lynn Haven, FL (US); James L. Arias, Panama City Beach, FL (US); John S. Kowals, Panama City Beach, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/738,334

(22) Filed: Dec. 18, 2003

(51) Int. Cl.[7] ..... B65B 1/04

(52) U.S. Cl. ..... 141/94; 141/95; 141/198; 700/282

(58) Field of Search ..... 141/95, 192, 198, 141/234, 237, 242, 243, 94, 83

(56) References Cited

U.S. PATENT DOCUMENTS 5,515,888 A * 5/1996 Graffin ..... 141/1
6,334,471 B1 * 1/2002 Graffin ..... 141/83
6,530,402 B2 * 3/2003 Suzuki et al. ..... 141/94

* cited by examiner

*Primary Examiner*—Steven O. Douglas
(74) *Attorney, Agent, or Firm*—James T. Shepherd; Donald G. Peck

(57) ABSTRACT

An automatic control method for the filling of multiple tanks is provided. A controllable valve is coupled to a liquid supply source so that liquid dispensed therefrom must pass through the valve when the tanks are being filled. A variety of conditions/states are monitored and averaged. The averaged conditions/states are evaluated to determine if a valve movement is warranted. If so, the valve is moved by a specified increment. Following each occurrence of a valve movement, a predetermined wait or delay time is implemented before further control processing takes place. The steps of monitoring/averaging, valve movement, and waiting after a valve movement, are repeated until one of a number of events occurs. The occurrence of one of these events initiates a finalize filling process that fully closes the valve in accordance with a series of discrete movements thereof carried out over a specified time period.

13 Claims, 5 Drawing Sheets

PROCESSOR
110
FUEL SUPPLY
20
18
100
TLI
102
PS
104
TANK
10
16A
TLI
102
TANK
12
16B
TLI
102
TANK
14
22
TLI
102
OS
106
FM
108
24A
EXPANSION OVERFLOW TANK
24

FUEL SUPPLY
58
100
FM
108
SUPPLY MANIFOLD
56
PROCESSOR
110
OS
106
RISER PIPE
60
TLI
102
EXPANSION OVERFLOW TANK
62
TANK
50
50A
TANK
52
52A
TANK
54
54A

LIQUID FILLING CONTROL METHOD FOR MULTIPLE TANKS

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to the filling of multiple tanks with a liquid, and more particularly to an automatic control method that governs the filling of multiple tanks with a liquid.

BACKGROUND OF THE INVENTION

Filling or re-filling a ship's fuel tanks is a process that can take place in port or at sea. In either case, the process of pumping a supply of fuel into the ship's fuel tanks requires personnel to monitor a variety of flow rate, pressure and tank level sensors. The sensor outputs must then be evaluated and fuel flow rates must be adjusted in order to quickly and safely fill the fuel tanks without any unwanted pressure build-up and/or fuel overflow that results when fuel is pumped even after the fuel tanks have been filled to capacity. It is sometimes more difficult at sea to quickly and safely fill fuel tanks because sea state conditions can have an intermittent impact on tank levels.

SUMMARY OF THE INVENTION

Accordingly, it is an object of the present invention to provide a method of automatically controlling the filling of multiple tanks with a liquid.

Another object of the present invention is to provide a method of automatically controlling the filling of a ship's fuel tanks.

Other objects and advantages of the present invention will become more obvious hereinafter in the specification and drawings.

In accordance with the present invention, a method is provided to automatically control the filling of a plurality of tanks with a liquid from a supply source. The tanks are equipped with an overflow sensing capability that detects an overflow condition indicative of the tanks being filled to capacity. A controllable valve is coupled to the supply source so that liquid dispensed therefrom must pass through the valve when the tanks are being filled. The valve has an increment associated therewith that defines how much the valve can be opened and closed when liquid is being dispensed therethrough. To start the filling process, the valve is opened to an initial position that defines a flow rate therethrough that falls within a prescribed range of acceptable flow rates. The liquid is then dispensed from the supply source through the controllable valve in its initial position. Each of (i) a flow rate of the liquid being dispensed, (ii) a level of the liquid in each of the tanks, and (iii) a state of the overflow sensor(s), is monitored and averaged over an amount of time. As a result, a corresponding (i) average flow rate, (ii) average level, and (iii) average state are defined. The valve is moved by its associated increment when the average flow rate is outside the range of acceptable flow rates. Specifically, the valve is closed by an amount equal to the increment when the average flow rate is greater than the range, and the valve is opened by an amount equal to the increment when the average flow rate is less than the range. Following each occurrence of a valve movement, a predetermined wait or delay time is implemented before further control processing takes place. The steps of monitoring/averaging, valve movement, and waiting after a valve movement, are repeated until one of a number of events occurs. A finalize filling process is initiated when one of these events occurs. These events include: (i) the average level being equal to a predetermined percentage of the capacity of the tanks, and (ii) the average state indicating the prescribed overflow condition. The finalize filling process fully closes the valve in accordance with a series of discrete movements thereof carried out over a specified time period.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
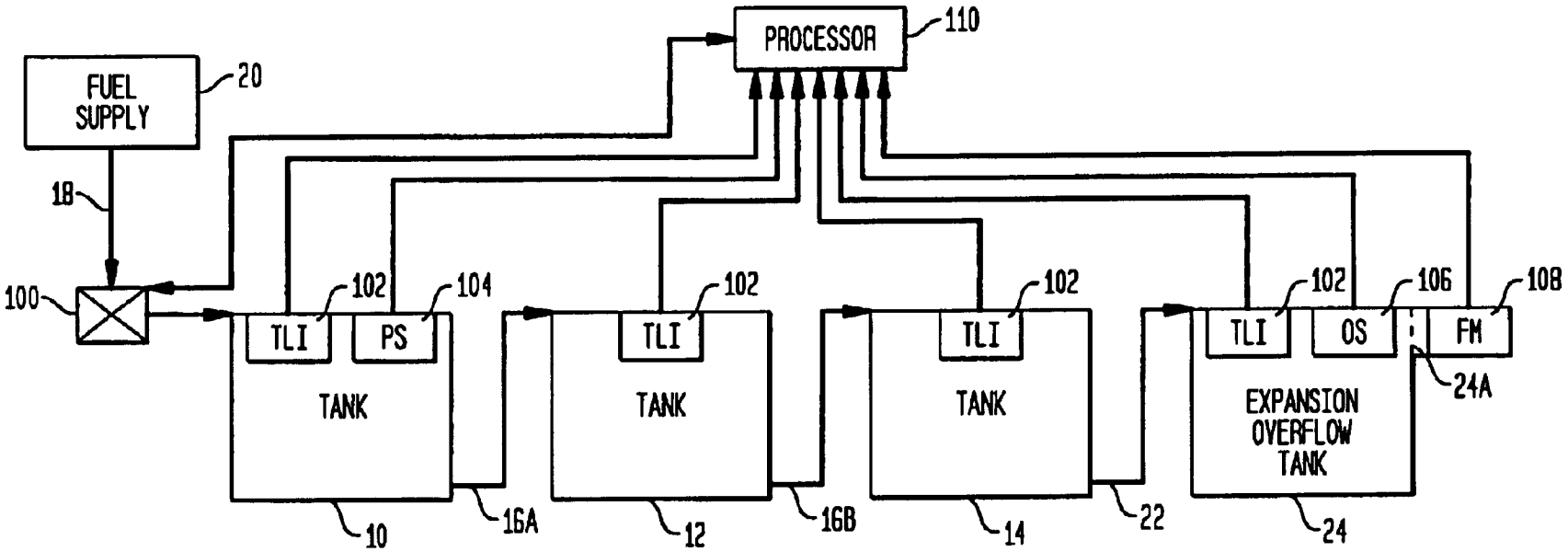
FIG. 1 is a schematic view of a seawater-compensated fuel tank system that is to be automatically filled with fuel in accordance with the present invention.
Figure 2:
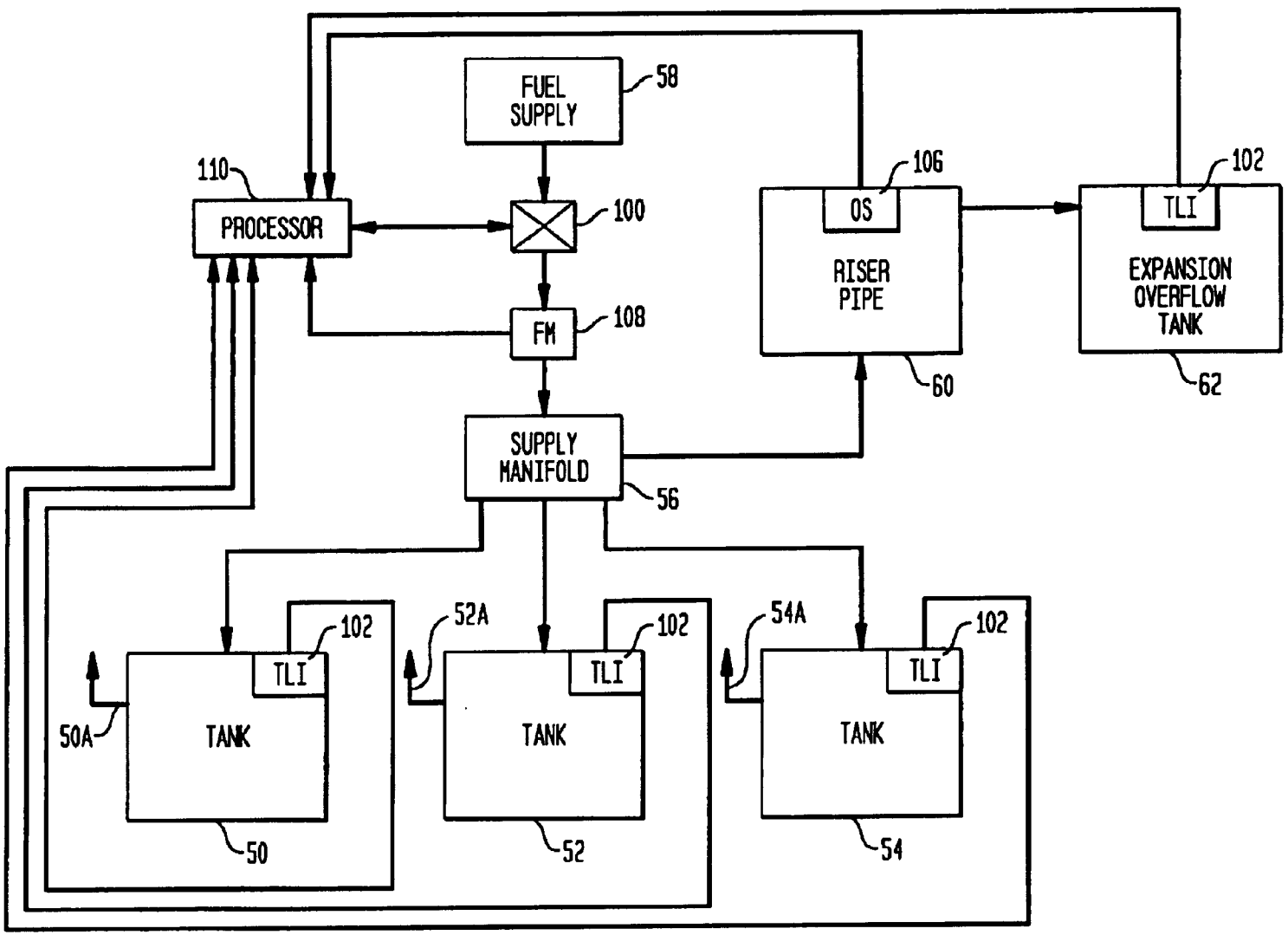
FIG. 2 is a schematic view of a non-compensated fuel tank system that is to be automatically filled with fuel in accordance with the present invention.

Referring now to the drawings, and more particularly to FIGS. 1 and 2, two types of multiple-tank storage systems are illustrated. By way of example, both storage systems will be described herein as they relate to fuel storage systems used onboard a ship. However, it is to be understood that the method of the present invention can be used with either of the multiple-tank storage systems shown regardless of the liquid being supplied thereto.

FIG. 1 illustrates a seawater-compensated fuel storage system in which a plurality of tanks 10, 12 and 14 are coupled together in a serial fashion such that the tanks are filled successively. More or fewer tanks can be controlled by the method of the present invention. In the illustrated example, tanks 10, 12 and 14 are successively coupled to one another via conduits 16A and 16B. Coupled to the first tank (i.e., tank 10) via conduit 18 is a fuel supply 20. Coupled to the last tank (i.e., tank 14) via conduit 22 is an expansion overflow reservoir or tank 24 which vents or empties via an orifice 24A to a surrounding seawater environment.

It is well known in the art that each of tanks 10, 12 and 14 is filled with seawater prior to being filled with fuel from fuel supply 20. As tank 10 fills with fuel from the top thereof, the seawater contained in tank 10 is forced out the bottom of the tank and through conduit 16A (e.g., a sluice pipe) and into the top of tank 12. In turn, seawater in tank 12 is forced out through conduit 16B and into tank 14. This, in turn, forces seawater in tank 14 out through conduit 22 and into overflow tank 24. Accordingly, once tank 10 is filled with fuel as opposed to seawater, the continuous supply of fuel causes the subsequent and successive filling of tanks 12 and 14. The pumping of fuel into tank 10 continues until fuel in tank 14 reaches a pre-designated level. One of the goals of the fueling process is to avoid overfilling the system with fuel such that fuel passes through orifice 24A into the surrounding seawater environment.

In order for the above-described process to be carried out quickly, fuel is pumped using high flow rates. However, the use of high flow rates in combination with the closed (i.e., non-vented) nature of a seawater-compensation system means that pressure build-up in the tanks must be closely monitored to avoid a catastrophic event.

FIG. 2 illustrates a non-compensated fuel storage system in which a plurality of tanks (e.g., tanks 50, 52 and 54) are filled with fuel distributed thereto by a supply manifold 56 that receives fuel from a fuel supply 58. An overflow reservoir in the form of a riser pipe 60 is coupled to supply manifold 56. Riser pipe 60 fills with fuel and subsequently overflows (into an expansion overflow tank 62) once tanks 50, 52 and 54 are filled, or if the flow rate of fuel into manifold 56 exceeds the combined flow rate capacities of tanks 50, 52 and 54. Each of tanks 50, 52 and 54 is vented to the atmosphere as indicated by arrows 50A, 52A and 54A, respectively. Accordingly, the non-compensated system is not subject to the potential pressure problem associated with the above-described seawater-compensated system. However, the high flow rates used to fill tanks 50, 52 and 54 can quickly cause an overflow condition at riser pipe 60.

The above-described problems associated with the filling of multiple-tank systems are addressed and eliminated by the method of the present invention. Automatic control provided by the present invention will be explained with reference to FIGS. 3A–3C which provides a flow diagram of the method as it relates to, for example, a seawater-compensated system such as that illustrated in FIG. 1. To implement the method, an adjustable or controllable valve 100 is placed in-line with conduit 18 that directs fuel from fuel supply 20 to (first) tank 10. Controllable valve 100 is any valve device that can be controlled in terms of how much it is opened/closed. A variety of such valve devices are well known in the art and the choice thereof is not a limitation of the present invention.

Each of tanks 10, 12, 14 and 24 has a tank level indicator ("TLI") 102 mounted therein to detect the level of fuel in each tank. One of tanks 10, 12 and 14 (e.g., tank 10 in FIG. 1) has a pressure sensor ("PS") 104 mounted therein to detect pressure in the tank. Because of the closed nature of a seawater-compensated tank group system, the pressure detected in any one tank is indicative of pressure anywhere in the seawater-compensated system. An overflow system ("OS") 106 is mounted in overflow tank 24 to detect an overflow condition, i.e., tanks 10, 12 and 14 are filled to capacity with fuel. For the seawater-compensated system, fuel will begin to flow into overflow tank 24 when tanks 10, 12 and 14 are filled. Accordingly, overflow sensor 106 can be realized by any sensing device (e.g., a float switch) that detects the presence of fuel in overflow tank 24.

The flow rate of fuel going through the seawater-compensated system can be measured anywhere therein. For example, a flow meter ("FM") 108 can be coupled to orifice 24A so that flow therefrom passes by or through flow meter 108. A flow meter coupled to orifice 24A will measure seawater bieng discharged overboard as a means of measuring the fuel that enters the tank group. This approach is successful because the quantity of seawater discharged equals the quantitiy of fuel supplied to the tank group. Note that this placement of flow meter 108 may prove to be the most convenient since orifice 24A will normally be located at or near the ship's hull. The outputs of tank level indicators 102, pressure sensor 104, overflow sensor 106 and flow meter 108 are provided to a processor 110.

Figure 3A:
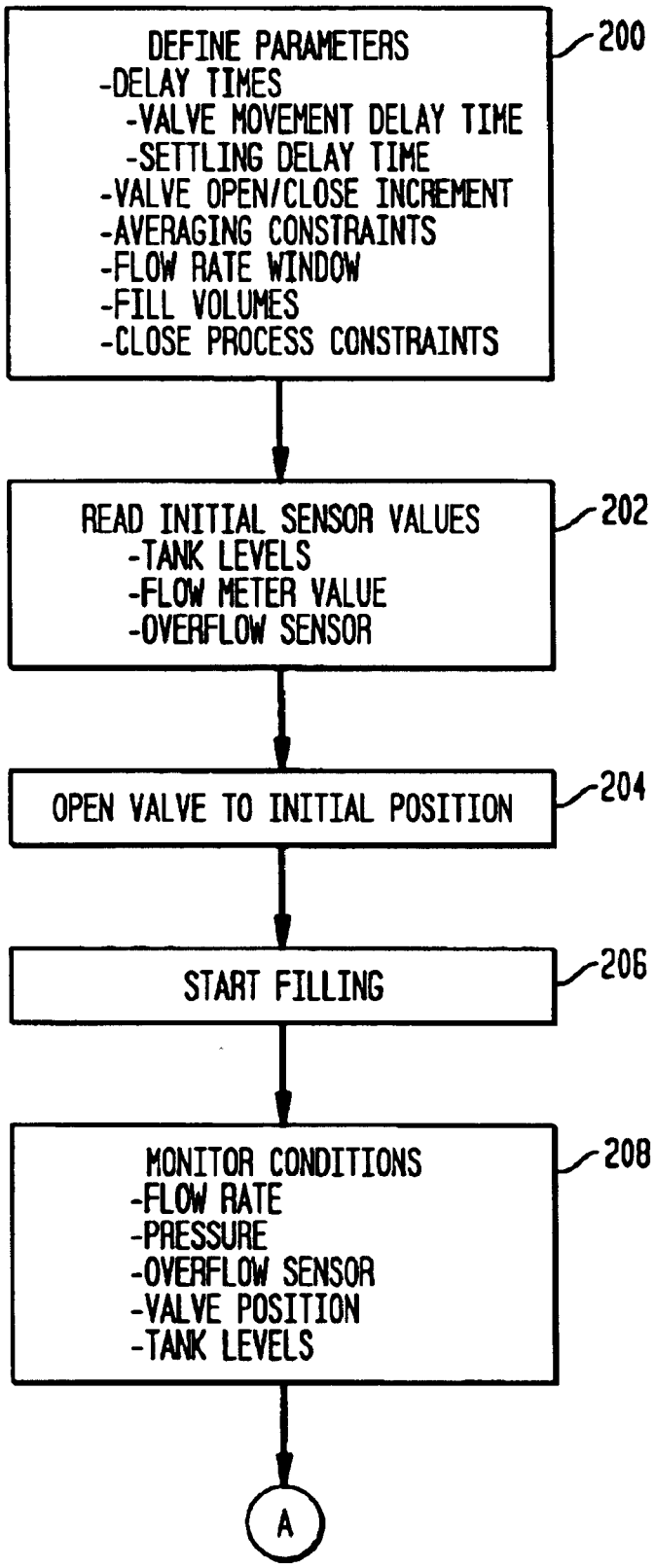
FIGS. 3A–3C are a flow diagram of the present invention's method for automatically controlling the filling of multiple tanks such as serially-connected tanks in a seawater-compensated fuel tank system.
Figure 3B:
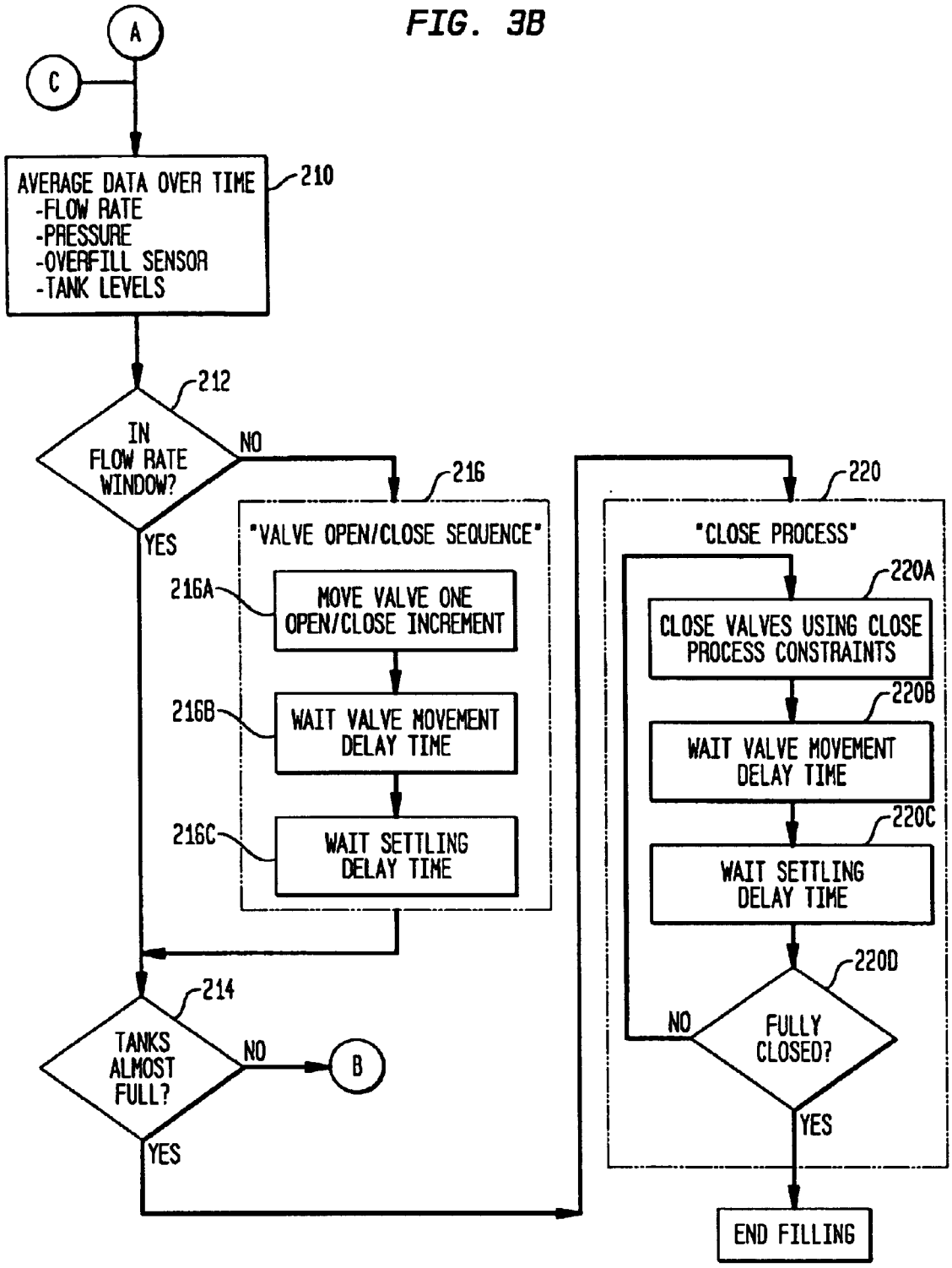
Figure 3C:
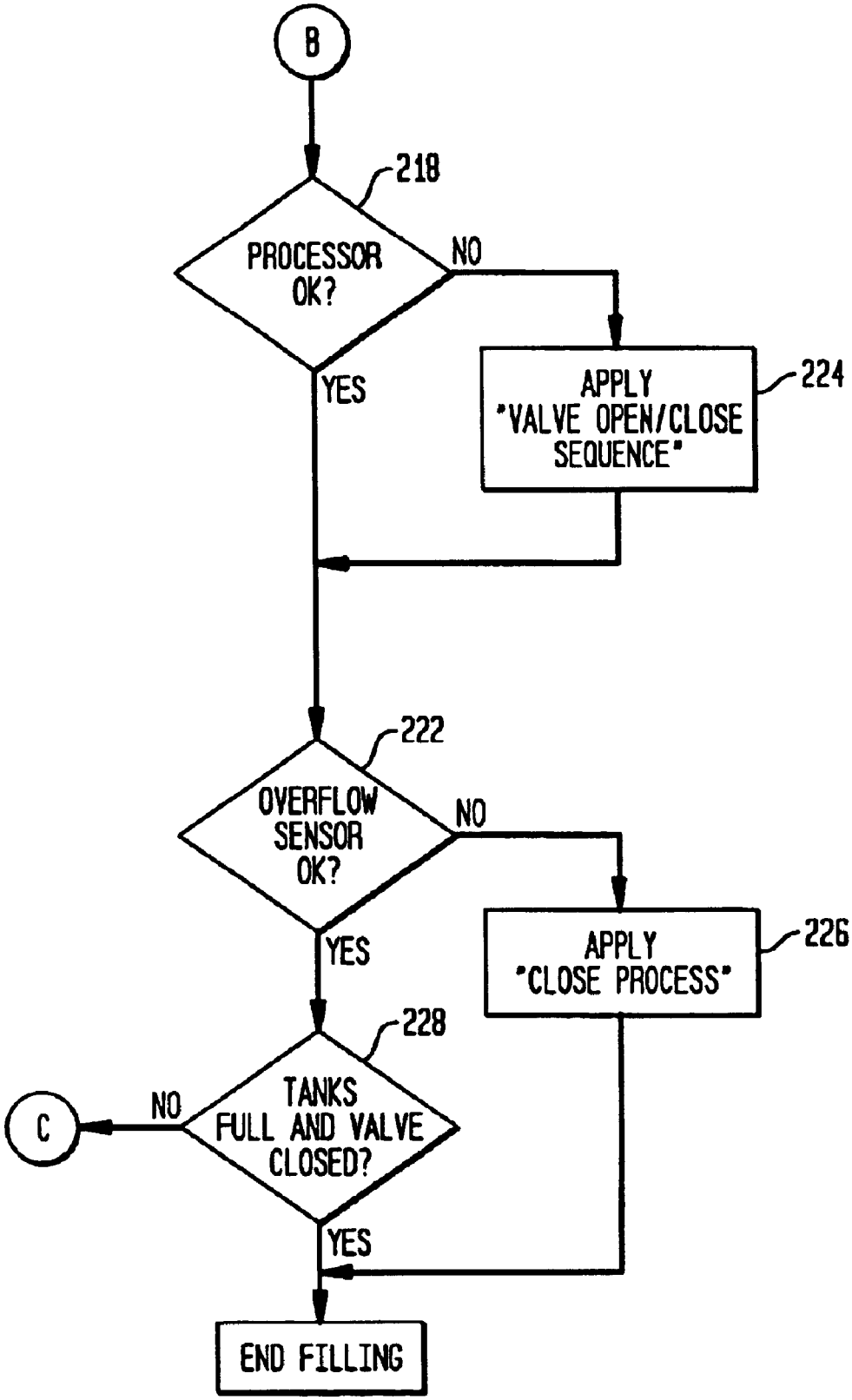

Processor 110 controls implementation of the method illustrated in FIGS. 3A-3C. At step 200, a variety of parameters are defined for use in implementing the automatic control process. These parameters can be predetermined (i.e., pre-programmed in processor 110) or can be user-supplied/changed without departing from the scope of the present invention. Briefly, the parameters include:

(a) valve movement and settling delay times which are used to delay further processing after each valve movement, (b) a valve open/close increment that defines how much controllable valve 100 can be adjusted at any one time during the filling of the tanks, (c) constraints on an averaging process used by the method, (d) a range or window of flow rate values that are acceptable for the filling of tanks 10, 12 and 14, (e) the volume that each of tanks 10, 12 and 14 can hold, and (f) the constraints governing the closing of controllable valve 100 when the tanks are almost filled.

Initial readings of tank level indicators 102, overflow sensor 106 and flow meter 108 are taken at step 202, followed by the opening of controllable valve 100 (step 204) to its initial position which should define a flow rate therethrough falling within the flow rate window defined in step 200. Step 206 starts the filling process as fuel from supply 20 is pumped through controllable valve 100. The position of controllable valve 100 as well as the outputs of tank level indicators 102, pressure sensor 104, overflow sensor 106 and flow meter 108 are monitored (step 208) and are provided to processor 110. Processor 110 accumulates (i.e., averages) this data at step 210 for a period of time defined by the averaging constraints provided thereto. By averaging the data, the effects of data "peaks" and "valleys" associated with changing sea state, signal dropout, etc., are minimized. The time period for averaging as well as the data sampling rate over this time period are application specific and are not limitations of the present invention.

The average flow rate from the set of averaged data is first evaluated at step 212. If the average flow rate is within the defined flow rate window, controllable valve 100 is not adjusted and processing continues with step 214. However, if the average flow rate is outside (i.e., above or below) the defined flow rate window, a valve open/close sequence is performed at step 216. Specifically, at step 216A, processor 110 issues an instruction to controllable valve 100 to open (if the average flow rate is less than the defined window) or close (if the average flow rate is greater than the defined window) an amount equal to the previously-defined valve open/close increment. Following the issuance of this control instruction, further processing is delayed by the combination of the valve movement delay time (step 216B) and the settling delay time (step 216C). The valve movement delay time is the amount of time required for controllable valve 100 to move an amount equal to the previously-defined valve open/close increment. This delay time is specific for the particular controllable valve 100. The settling delay time represents the amount of time needed for the various monitored parameters to settle out after a movement of controllable valve 100. Settling delay time is predicated on a variety of factors such as the number of tanks being filled and the location of flow meter 108 relative to controllable valve 100 (i.e., the farther apart they are, the greater the settling delay time). Accordingly, the settling delay time may be an adaptive parameter.

At the completion of step 216 (or if the average flow rate is within the acceptable flow rate window), step 214 evaluates the fill status of tanks 10, 12 and 14 by evaluating the fill status of the last tank, i.e., tank 14. Specifically, the averaged outputs of tank level indicator 102 in tank 14 is checked to see if it indicates that the tank is almost fully filled with fuel, i.e., whether the average fuel level in the tank has achieved a certain percentage (e.g., 85%, 90%, etc.) of full capacity. If this percentage has not been achieved, processing continues to step 218 (FIG. 3C). However, if the percentage has been achieved, a close process 220 is implemented. In general, close process 220 involves a stepwise or incremental closing of controllable valve 100 based on the amount that controllable valve 100 is opened at the start of close process 220. More specifically, the initially-defined close process constraints are used at step 220A to generate the closing increment and then close valve 100 by an amount equal to this increment. The closing increment could be determined based on a set number of closing increments, incremental flow volume reductions, or a combination thereof. Following the movement of controllable valve 100 in accordance with the closing increment, processing is delayed by the combination of valve movement delay time (step 220B) and settling delay time (step 220C). The position of controllable valve 100 is then evaluated at step 220D. If control valve 100 is not fully closed, steps 220A–220C are repeated. If controllable valve 100 is fully closed, automatic control of the filling process is complete.

As mentioned above, processing continues from step 214 to step 218 if the average level in the tank 14 has not reached its prescribed "near capacity percentage". Since this means that the filling of tanks is continuing, step 218 evaluates the reading from pressure sensor 104. If the pressure reading is below a given pressure threshold, processing continues with step 222. However, if the pressure reading is above the pressure threshold, the present invention reduces the flow through controllable valve 100 by implementing the previously-described (step 216) valve open/close sequence at step 224.

Step 222 involves evaluating the average of the readings provided by overflow sensor 106. The type of readings provided by overflow sensor 106 are not a limitation of the present invention. For example, overflow sensor 106 could be a float switch activated when fuel (which is lighter than water) is present in overflow tank 24. However, it is to be understood that overflow sensor 106 could be any type of sensing device used to detect when there is the presence and/or a specified amount of fuel in overflow tank 24. If the average readings from overflow sensor 106 indicate the presence of fuel in overflow tank 24, the present invention initiates the previously-described (step 220) close process at step 226, the completion of which ends the filling process. However, if the average readings from the overflow sensor 106 are acceptable, processing continues with step 228 where the average tank levels and position of controllable valve 100 are evaluated. If tank 14 is full and controllable valve 100 is closed, the filling process is ended. If this condition is not met, processing returns to step 210 where data is again averaged and then evaluated as described above.

The same process steps can be applied to the filling of a non-compensated fuel tank system such as that shown in FIG. 2. Accordingly, this system is shown with:

(i) controllable valve 100 in line between fuel supply 58 and manifold 56, (ii) tank level indicators 102 in each of tanks 50, 52 and 54, and in expansion overflow tank 62, (iii) overflow sensor 106 coupled to riser pipe 60 for detecting the presence/amount of fuel therein, and (iv) flow meter 108 in line between controllable valve 100 and supply manifold 56.

Note that since this is a vented system, traditional pressure sensing is not required thereby eliminating the need for steps 218 and 224. However, a pressure sensor (not shown) can be included at the bottom of riser pipe 60 to measure the static head of any fuel contained in riser pipe 60. Knowledge of pressure at this point in riser pipe 60 can be of value since their is a linear correlation between the static head pressure and fluid level in the riser pipe. Thus, pressure sensing at this point in riser pipe 60 provides a redundant system with respect to sensing any overflow in manifold 56.

The advantages of the present invention are numerous. Efficient and safe filling of multiple tanks from a supply is controlled automatically by the present invention. In terms of filling a ship's tanks with fuel, the present invention eliminates problems associated with operator error and operator delay.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A method of automatically controlling the filling of a plurality of tanks with a liquid from a supply source, the plurality of tanks being equipped with overflow sensing means that detects an overflow condition indicative of the plurality of tanks being filled to capacity, said method comprising the steps of:

coupling a controllable valve to the supply source wherein the liquid dispensed therefrom must pass through said controllable valve when the plurality of tanks are being filled;

providing an increment that said controllable valve can be opened and closed when liquid is being dispensed therethrough;

opening said controllable valve to an initial position, wherein said initial position defines a flow rate through said controllable valve that falls within a range of acceptable flow rates;

dispensing the liquid from the supply source through said controllable valve in said initial position;

monitoring, for an amount of time, each of (i) a flow rate of the liquid being dispensed, (ii) a level of the liquid in each of the plurality of tanks, and (iii) a state of the overflow sensing means, wherein (i) an average flow rate, (ii) an average level, and (iii) an average state, respectively, are defined for said amount of time;

moving said controllable valve by said increment when said average flow rate is outside said range of acceptable flow rates, wherein said controllable valve is closed by an amount equal to said increment when said average flow rate is greater than said range, and wherein said controllable valve is opened by an amount equal to said increment when said average flow rate is less than said range;

waiting a predetermined wait time following an occurrence of said step of moving; and initiating a finalize filling process when one of a number of events occurs, said number of events including (i) said average level being equal to a predetermined percentage of the capacity of the plurality of tanks, and (ii) said average state indicating said overflow condition, said finalize filling process fully closing said controllable valve in accordance with a series of discrete movements of said controllable valve carried out over a specified time period; and repeating said steps of monitoring, moving and waiting until one of said number of events occurs.

2. A method according to claim 1 wherein said predetermined wait time used in said step of waiting is equal to the sum of (i) a first time interval equal to the time needed for said controllable valve to move said increment, and (ii) a second time interval selected to allow said flow rate to settle out after said controllable valve moves said increment.

3. A method according to claim 1 wherein the plurality of tanks are part of a seawater-compensated system with the plurality of tanks being coupled together in a series configuration, the supply source is coupled to a first tank in the series configuration via said controllable valve, and prior to said step of repeating, said method further comprises the steps of:

monitoring, for said amount of time, pressure in one of the plurality of tanks wherein an average pressure is defined for said amount of time;

closing said controllable valve by an amount equal to said increment when said average pressure exceeds a pressure threshold; and waiting said predetermined wait time following an occurrence of said step of closing.

4. A method according to claim 1 wherein the plurality of tanks are part of a seawater-compensated system with the plurality of tanks being coupled together in a series configuration, the supply source is coupled to a first tank in the series configuration via said controllable valve and an overflow reservoir is coupled to a last tank in the series configuration with the overflow reservoir having an orifice through which seawater flows when the liquid is being dispensed to fill the plurality of tanks, and said step of monitoring said flow rate comprises the step of monitoring the seawater passing through the orifice of the overflow reservoir.

5. A method according to claim 4 wherein the overflow sensing means is coupled to the overflow reservoir, wherein said step of monitoring said state of the overflow sensing means comprises the step of using the overflow sensing means to check for presence of the liquid in the overflow reservoir wherein said presence of the liquid is indicative of said overflow condition.

6. A method according to claim 1 wherein a supply manifold is coupled between said controllable valve and the plurality of tanks, wherein said step of monitoring said flow rate is carried out between said controllable valve and the supply manifold.

7. A method according to claim 6 wherein an overflow reservoir is coupled to the supply manifold with the overflow sensing means coupled to the overflow reservoir, and said step of monitoring said state of the overflow sensing means comprises the step of using the overflow sensing means to check for presence of the liquid in the overflow reservoir wherein said presence of the liquid is indicative of said overflow condition.

8. A method of automatically controlling the filling of a ship's fuel tanks with fuel from a supply source, the fuel tanks being equipped with overflow sensing means that detects an overflow condition indicative of the fuel tanks being filled to capacity, said method comprising the steps of:

coupling a controllable valve to the supply source wherein the liquid dispensed therefrom must pass through said controllable valve when the plurality of tanks are being filled;

providing an increment that said controllable valve can be opened and closed when liquid is being dispensed therethrough;

opening said controllable valve to an initial position, wherein said initial position defines a flow rate through said controllable valve that falls within a range of acceptable flow rates;

dispensing the liquid from the supply source through said controllable valve in said initial position;

monitoring, for an amount of time, each of (i) a flow rate of the liquid being dispensed, (ii) a level of the liquid in each of the plurality of tanks, and (iii) a state of the overflow sensing means, wherein (i) an average flow rate, (ii) an average level, and (iii) an average state, respectively, are defined for said amount of time;

moving said controllable valve by said increment when said average flow rate is outside said range of acceptable flow rates, wherein said controllable valve is closed by an amount equal to said increment when said average flow rate is greater than said range, and wherein said controllable valve is opened by an amount equal to said increment when said average flow rate is less than said range;

waiting a predetermined wait time following an occurrence of said step of moving, said predetermined wait time being equal to the sum of (i) a first time interval equal to the time needed for said controllable valve to move said increment, and (ii) a second time interval based on a plurality of factors to include the number of fuel tanks and location of said controllable valve relative to where said flow rate is being monitored; and initiating a finalize filling process when one of a number of events occurs, said number of events including (i) said average level being equal to a predetermined percentage of the capacity of the fuel tanks, and (ii) said average state indicating said overflow condition, said finalize filling process fully closing said controllable valve in accordance with a series of discrete movements of said controllable valve carried out over a specified time period; and repeating said steps of monitoring, moving and waiting until one of said number of events occurs.

9. A method according to claim 8 wherein the fuel tanks are part of a seawater-compensated system with the fuel tanks being coupled together in a series configuration, the supply source is coupled to a first tank in the series configuration via said controllable valve, and prior to said step of repeating, said method further comprises the steps of:

monitoring, for said amount of time, pressure in one of the fuel tanks wherein an average pressure is defined for said amount of time;

closing said controllable valve by an amount equal to said increment when said average pressure exceeds a pressure threshold; and waiting said predetermined wait time following an occurrence of said step of closing.

10. A method according to claim 8 wherein the fuel tanks are part of a seawater-compensated system with the fuel tanks being coupled together in a series configuration, the supply source is coupled to a first tank in the series configuration via said controllable valve and an overflow reservoir is coupled to a last tank in the series configuration with the overflow reservoir having an orifice through which seawater flows when the liquid is being dispensed to fill the plurality of tanks, and said step of monitoring said flow rate comprises the step of monitoring the seawater passing through the orifice of the overflow reservoir.

11. A method according to claim 10 wherein the overflow sensing means is coupled to the overflow reservoir, wherein said step of monitoring said state of the overflow sensing means comprises the step of using the overflow sensing means to check for presence of fuel in the overflow reservoir wherein said presence of fuel is indicative of said overflow condition.

12. A method according to claim 8 wherein a supply manifold is coupled between said controllable valve and the fuel tanks, wherein said step of monitoring said flow rate is carried out between said controllable valve and the supply manifold.

13. A method according to claim 12 wherein an overflow reservoir is coupled to the supply manifold with the overflow sensing means coupled to the overflow reservoir, and said step of monitoring said state of the overflow sensing means comprises the step of using the overflow sensing means to check for presence of fuel in the overflow reservoir wherein said presence of fuel is indicative of said overflow condition.

* * * * *